United States Patent [19]

Kahler

[11] 4,108,152

[45] Aug. 22, 1978

[54] STORAGE COMPARTMENT CAP FOR LIQUID-FILTERED SMOKING DEVICE

[76] Inventor: Richard W. Kahler, Rte. 1, Box 61, Rock Cave, W. Va. 26234

[21] Appl. No.: 735,270

[22] Filed: Oct. 26, 1976

Related U.S. Application Data

[63] Continuation-in-part of Ser. No. 699,372, Jun. 24, 1976, which is a continuation-in-part of Ser. No. 509,941, Sep. 27, 1974, abandoned.

[51] Int. Cl.[2] ..... A24B 5/04; A24B 5/08; A24F 1/02; A24F 1/30

[52] U.S. Cl. ..... 131/173; 220/23

[58] Field of Search ..... 131/173; 220/23

[56] References Cited

U.S. PATENT DOCUMENTS

| | | | |
|---|---|---|---|
| 2,471,441 | 5/1949 | Moore | 220/23 |
| 2,862,637 | 12/1958 | Heldfond | 220/23 X |
| 3,581,927 | 6/1971 | Langdon | 220/23 X |
| 3,881,499 | 5/1975 | McFadden et al. | 131/173 |

*Primary Examiner*—Stephen C. Pellegrino
*Attorney, Agent, or Firm*—Schwartz & Weinrieb

[57] ABSTRACT

A liquid-filtered smoking device includes a liquid reservoir container for retaining a body of liquid, and is provided with an aperture within a sidewall portion thereof for receiving a tubular member which has a smoking bowl mounted upon the upper end thereof which projects upwardly and outwardly from the device. The lower end of the tubular member is immersed within the liquid, and the upper portion of the reservoir container is defined by another tubular member upon which a sealing, storage compartment cap is removably mounted. The cap seals the reservoir in a fluid-tight manner and also defines a storage compartment therein for housing, for example, tobacco or the smoking bowl, the cap being removed when the device is operatively used for smoking purposes.

5 Claims, 2 Drawing Figures

STORAGE COMPARTMENT CAP FOR LIQUID-FILTERED SMOKING DEVICE

This application is a continuation-in-part of my copending application Ser. No. 699,372, filed June 24, 1976, which is a continuation-in-part of my application Ser. No. 509,941, filed Sept. 27, 1974, now abandoned.

BACKGROUND OF THE INVENTION

1. Field of the Invention

The present invention relates generally to smoking devices, and more particularly to an improved liquid filtered smoking device which is particularly useful in connection with the smoking of rare and expensive tobaccos, readily adaptable to cleaning, portable, and is especially compact and transportable.

2. Description of the Prior Art

While prior art smoking devices utilizing water or other liquid mediums for filtering purposes are of course well known, wherein the smoke from the tobacco being consumed is drawn through the water or other medium, disposed in a suitable vessel, as a result of the inhalation of the same by the user, whereby the smoke is thus cooled and filtered by means of such medium, such prior art devices are subject to various disadvantages in that they normally consist of one or more flexible hoses which have a great tendency to become clogged as a result of the smoke which passes therethrough. They are also not particularly adapted for disassemblage, as the same normally comprise various screw-fittings, valves, water-tight seals, or the like, operatively associated with the tubing, and consequently, such prior art devices are not readily adaptable for cleaning. Still further, many of such prior art devices utilize a canvas bag for holding the liquid medium, however, as the fabric, per se, of such bags weather within a predetermined period of time, and in addition, as the same cannot be readily cleaned, the smoking devices must be discarded after such predetermined time periods.

Still yet further, as such prior art devices are also normally large and bulky, the same are not readily transportable, particularly in a compact condition. Consequently, special packaging must be fabricated for retaining or housing all of the ancillary components of the devices, and if the device is to be transported, for a particular reason, in its operative state, that is, with the liquid medium already disposed within the device, additional packing or packaging means must likewise be provided in order to properly seal the device and render the same liquid-tight and leak-proof.

OBJECTS OF THE INVENTION

Accordingly, it is an object of the present invention to provide a new and improved liquid-filtered smoking device.

Another object of the present invention is to provide a new and improved liquid-filtered smoking device which overcomes the disadvantages and problems characteristic of prior art smoking devices.

Still another object of the present invention is to provide a new and improved liquid-filtered smoking device which is capable of being easily assembled and disassembled so as to facilitate the cleaning thereof.

Yet another object of the present invention is to provide a new and improved liquid-filtered smoking device which is fabricated of component parts which render the device readily cleanable.

Still yet another object of the present invention is to provide a new and improved liquid-filtered smoking device which readily permits the disassemblage of the various components of the device and the disposition of such components within the primary component of the device so as to render the entire device compact, portable, and transportable.

A further object of the present invention is to provide a new and improved liquid-filtered smoking device which is sealed in a fluid-tight manner so as to facilitate transportation of the same even when already charged with the liquid-filtering medium.

A still further object of the present invention is to provide a new and improved liquid-filtered smoking device which includes additional storage compartment means for storing various components or accessories for the device, particularly the smoking bowl or tobacco, in a simple and fluid-tight manner.

A yet further object of the present invention is to provide a new and improved liquid-filtered smoking device which is sturdy and rugged in construction, and relatively simple and, therefore, inexpensive to manufacture.

BRIEF DESCRIPTION OF THE INVENTION

The foregoing and other objects are achieved in accordance with the present invention through the provision of a liquid-filtered smoking device which includes a liquid reservoir container, which may, for example, have a gibbous-like configuration, the bottom enlarged portion of which serves as the base supporting member for the device while the upper portion thereof serves as the smoke withdrawal portion. The base of the device may include an axially inwardly projecting portion, defining a through-hole therethrough, which is adapted to be operatively mated with a removable sealing cover, such structure facilitating access to the interior of the device for cleaning purposes yet rendering the same liquid-tight during operation of the device.

The reservoir is also provided with an aperture within a sidewall portion thereof for receiving a tubular member which supports a smoking bowl at the upper end thereof while the lower end thereof is immersed within the liquid within the reservoir, and a seal cap, including a storage compartment defined therein, is removably seated upon the upper portion of the reservoir. The storage compartment of the seal cap may be utilized, for example, for storing the smoking bowl or tobacco, during transportation of the device, while the cap, per se, seals the device in a fluid-tight manner. The cap is of course removed during operative smoking of the device.

BRIEF DESCRIPTION OF THE DRAWINGS

Various other objects, features, and attendant advantages of the present invention will be more fully appreciated as the same becomes better understood from the following detailed description, when considered in connection with the accompanying drawings, wherein like reference characters designated like or corresponding parts throughout the several views, and in which.

DETAILED DESCRIPTION OF A PREFERRED EMBODIMENT

Figure 1:
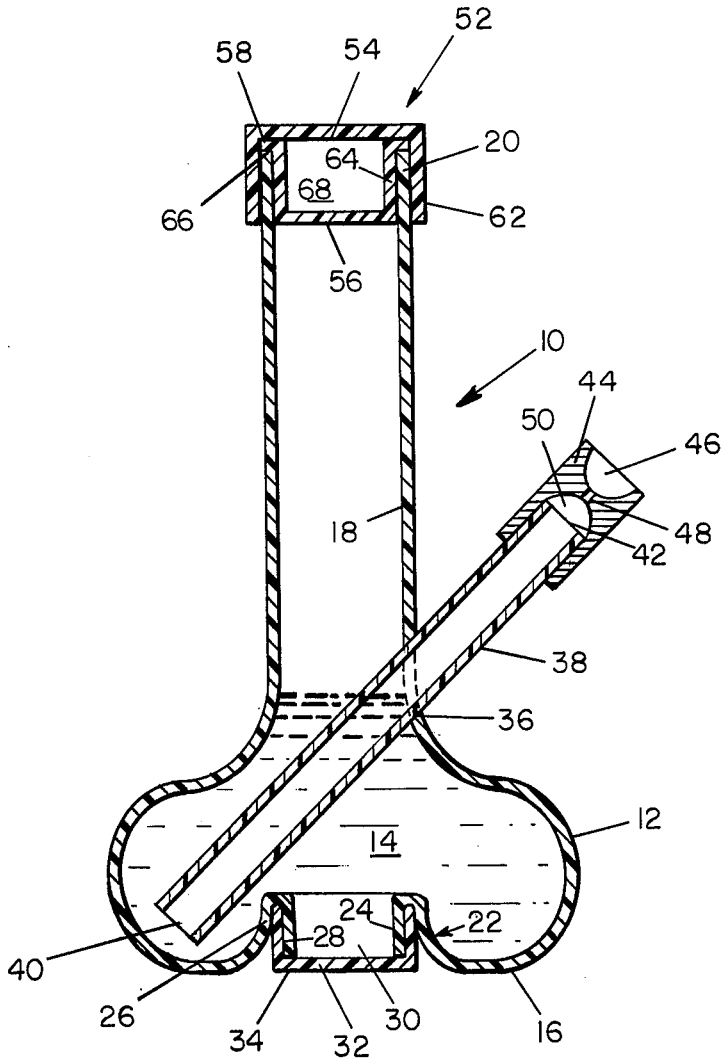
FIG. 1 is a vertical, cross-sectional view of a liquid-filtered smoking device constructed in accordance with the present invention and showing its cooperative parts.

Referring now to the drawings, and more particularly to FIG. 1 thereof, a liquid-filtered smoking device, generally indicated by the reference character 10, is seen to include a substantially gibbous-like reservoir 12, which is adapted to hold or house a body of liquid 14 for cooling and filtering the smoke of the device, as will be more apparent hereinafter, the lower portion of reservoir 12 serving to define an annular planar base portion 16 while the upper portion thereof has integrally secured thereto an upwardly extending tubular member 18 which is open at the upper end 20 thereof.

The lower portion of reservoir 12 also includes an axially, inwardly projecting portion 22 which includes a reversely curved or bent annular wall portion 24 which is spaced radially inwardy from an outer annular wall portion 26 so as to define therewith and therebetween an annular space 28. The lower end of wall 24 is open, and consequently, wall 24 serves to define a central aperture or opening 30 which extends into reservoir 12. A substantially cup or U-shaped cover or cap member 32 is adapted to be removably, frictionally fitted within annular space 28 so as to seal aperture or opening 30 in a fluid-tight manner whereby liquid 14 may in fact be retained within reservoir 12, or alternatively provide access to the interior of reservoir 12 for cleaning purposes. It will also be noted that in order to facilitate the stability of the device 10, the bottom planar surface 34 of cup 32 is co-planar with base portion 16. Still further, the liquid 14 may be any suitable liquid, such as, for example, water, wine, or the like, however, water is preferred in view of the economy and availability of the same.

An aperture 36 is defined within a sidewall portion of the device at approximately a juncture point of reservoir 12 and tubular member 18, and another tubular member 38, open at both ends thereof, is adapted to be inserted through aperture 36 such that the bottom end 40 thereof is immersed within liquid 14 while the upper end 42 thereof projects outwardly from the device, tubular member 38 being inclined upwardly with respect to the longitudinal axis of the device. The diameter of member 38 is substantially less than that of member 18, and the length of member 38 is likewise less than that of the device 10 as defined by member 18 and the depth of reservoir 12, and consequently, upon being disassembled or removed from the device 10, member 38 may be housed internally within the device, such as, for example, for transportation purposes. It is of course to be understood that upon tubular member 38 being removed from aperture 36 and the device, that is, from its operative position therein, so as to be housed internally within the device, that is, within tubular member 18 and reservoir 12, a suitable plug, not shown, will be inserted within aperture 36 so as to likewise render the same fluid-tight.

A smoking bowl 44, which is preferably a reversible smoking bowl, as more particularly disclosed and described in U.S. Pat. Nos. 3,872,872 and 3,863,646, is seated upon the upper end 42 of tubular member 38. As may be appreciated, tobacco may be housed, for example, within an outer compartment 46 of bowl 44 and the smoke therefrom is allowed to pass through bowl 44 by means of a central aperture 48, fluidically interconnecting compartment 46 with a lower compartment 50.

In operation, the smoke from lower compartment 50 of bowl 44 is of course conducted into tubular member 38, as a result of a user inhaling upon the upper, open end 20 of tubular member 18, and as the smoke exits out of lower end 40 of tubular member 38, the same enters liquid 14 and is filtered and cooled thereby. Subsequently, the smoke exits from the liquid 44 and is conducted upwardly within tubular member 18 so as to be inhaled by the user.

Figure 2:
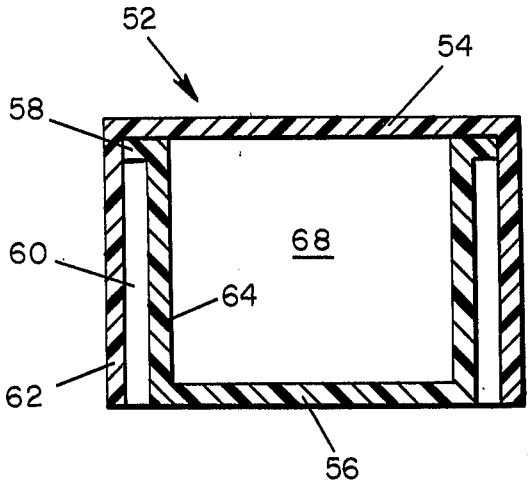
FIG. 2 is an enlarged cross-sectional view of a sealing, storage cap to be mounted upon the device of FIG. 1 as shown in FIG. 1.

As will also be appreciated from FIGS. 1 and 2, a removable cap member, generally indicating by the reference character 52, is mounted upon the upper, open end 20 of tubular member 18 by means of, for example, a friction fitting so as to sealingly close end 20 of the device in a fluid-tight manner. In this manner, the device may be shipped or transported with liquid 14 already charged thereinto, cup 32 also being fitted upon the device in a fluid-tight manner as more particularly described hereinabove. Both cap members 32 and 52 may be fabricated of a resilient material, such as, for example, synthetic rubber, or the like.

As is best seen from FIG. 2, cap member 52 is seen to comprise an outer, substantially inverted U-shaped cup member 54 and an inner, substantially U-shaped member 56. The upper end of cup member 56 is provided with an annular flange or lip 58 disposed about the outer periphery thereof, and the outside diameter of flange 58 is substantially equal to the inside diameter of cup member 54 so as to define a friction fitting therewith. In addition, as a result of the provision of flange 58, an annular space 60 is defined between the circumferential walls 62 and 64 of the outer and inner cup members, respectively, within which is accommodated, in a likewise friction-fit manner, the upper end portion 20 of tubular member 18, as best seen in FIG. 1, flange 58 being seated upon the circumferential lip or edge 66 of upper end portion 20.

It will also be appreciated that as a result of the mating of cup members 54 and 56 in the oppositely disposed disclosed manner, and with the upper peripheral surface of flange 58 abutted against the interior end face of cup 54, a cylindrical storage compartment 68 is defined thereby and therewithin. As a result of the fluid-tight characteristics of compartment 68, the same may of course be utilized for storing tobacco or other implements, such as, for example, tobacco bowl 44, of the device. In this manner, the entire device 10 may be rendered considerably compact and easily transportable as all implements, accessories, or the like, may be conveniently housed within reservoir 12, tubular member 18, and storage compartment 68.

Obviously, many modifications and variations of the present invention may be possible in light of the above teachings. For example, while the dual cap member 52 has been disclosed as being utilized upon a gibbous-type reservoir device, the cap member could likewise be utilized upon smoking devices of other configurations. It is to be understood therefore that within the scope of the appended claims, the present invention may be practiced otherwise than as specifically described herein.

What is claimed is:

1. In a smoking device having a container for housing a volume of fluid and including means defining a first opening therein;

means defining a second opening within said container;

tubular means open at both ends thereof, inserted through said second opening means such that one end of said tubular means is immersed within said volume of fluid while the other end thereof projects outwardly of said container;

smoking bowl means, for housing a predetermined volume of tobacco, mounted upon said other end of said tubular means and fluidically connected to said tubular means, the improvement comprising a cap means removably mounted upon said container so as to cover and seal said first opening, said cap comprising:

a first cup member having a substantially inverted U-shaped configuration;

a second cup member having a substantially U-shaped configuration, disposed interiorly of said first cup member, said cup members defining said storage compartment therebetween;

said second cup member having a flange formed about the upper, external periphery thereof; and said flange being in contact with the interior wall of said first cup member so as to separate the outer peripheral wall of said second member from the interior wall of said first member and thereby define an annular space therebetween for accommodating said container means defining said first opening.

2. A smoking device as set forth in claim 1, wherein: said smoking bowl is removable from said tubular means and is dimensioned so as to be capable of being housed within said storage compartment.

3. A smoking device as set forth in claim 1, wherein: said tubular means is removable from said second opening means and is dimensioned so as to be capable of being housed within said container.

4. A smoking device as set forth in claim 1, wherein: said second cup member is disposed within said first cup member by means of a friction-fitting so as to render said cap means fluid-tight.

5. A smoking device as set forth in claim 1, wherein: said annular space is dimensioned relative to said container means such that said cap means is mounted upon said container means by means of a friction-fitting so as to seal said container in a fluid-tight manner.

* * * * *